US010870820B2

(12) United States Patent
van Doorn et al.

(10) Patent No.: US 10,870,820 B2
(45) Date of Patent: Dec. 22, 2020

(54) WATER-SOLUBLE PACKAGE

(71) Applicant: Conopco, Inc., Englewood Cliffs, NJ (US)

(72) Inventors: Daniël Albert van Doorn, Vlaardingen (NL); Matthew Rhys Thomas, Bebington (GB)

(73) Assignee: Conopeo, Inc., Englewood Cliffs, NJ (US)

( * ) Notice: Subject to any disclaimer, the term of this patent is extended or adjusted under 35 U.S.C. 154(b) by 0 days.

(21) Appl. No.: 15/759,762

(22) PCT Filed: Aug. 4, 2016

(86) PCT No.: PCT/EP2016/068639

§ 371 (c)(1),
(2) Date: Mar. 13, 2018

(87) PCT Pub. No.: WO2017/025426

PCT Pub. Date: Feb. 16, 2017

(65) Prior Publication Data

US 2019/0048295 A1 Feb. 14, 2019

(30) Foreign Application Priority Data

Aug. 11, 2015 (EP) ..... 15180621

(51) Int. Cl.

| | |
|---|---|
| ***C11D 17/04*** | (2006.01) |
| ***C11D 3/37*** | (2006.01) |
| ***C11D 11/00*** | (2006.01) |
| ***B65D 65/46*** | (2006.01) |
| ***B65B 9/04*** | (2006.01) |

(52) U.S. Cl.
CPC ..... *C11D 17/042* (2013.01); *B65D 65/46* (2013.01)

(58) Field of Classification Search
None
See application file for complete search history.

(56) References Cited

U.S. PATENT DOCUMENTS

| | | | | |
|---|---|---|---|---|
| 4,917,303 | A | 4/1990 | Maas | |
| 4,991,778 | A | 2/1991 | Maas et al. | |
| 5,234,166 | A | 8/1993 | Foster et al. | |
| 5,294,025 | A | 3/1994 | Foster | |
| 5,397,060 | A | 3/1995 | Maas et al. | |
| 5,534,165 | A | 7/1996 | Pilosof et al. | |
| 5,626,259 | A | 5/1997 | Maas et al. | |
| 5,730,006 | A | 3/1998 | Conley | |
| 5,783,541 | A * | 7/1998 | Tack | C11D 3/3753 510/224 |
| 5,789,368 | A | 8/1998 | You uet al. | |
| 5,942,217 | A | 8/1999 | Woo et al. | |
| 5,955,093 | A | 9/1999 | Woo | |
| 5,968,404 | A | 10/1999 | Trinh | |
| 5,997,759 | A | 12/1999 | Trinh | |
| 6,033,679 | A | 3/2000 | Woo et al. | |
| 6,194,470 | B1 | 2/2001 | Lutz et al. | |
| 6,446,882 | B1 | 9/2002 | Dukes | |
| 6,491,840 | B1 | 12/2002 | Frankenbach et al. | |
| 6,495,058 | B1 | 12/2002 | Frankenbach et al. | |
| 6,528,013 | B1 | 3/2003 | Trinh et al. | |
| 7,012,053 | B1 | 3/2006 | Barnabas et al. | |
| 7,341,674 | B1 | 3/2008 | Trinh et al. | |
| 9,243,213 | B1 | 1/2016 | Vetter et al. | |
| 2002/0115581 | A1 | 8/2002 | DuVal | |
| 2002/0115584 | A1 | 8/2002 | Ongena et al. | |
| 2002/0148994 | A1 | 10/2002 | McGee | |
| 2002/0165109 | A1* | 11/2002 | Cropper | B05D 1/12 510/295 |
| 2003/0035748 | A1 | 2/2003 | Trinh et al. | |
| 2003/0068375 | A1* | 4/2003 | Wright | A61K 9/2013 424/468 |
| 2003/0071075 | A1 | 4/2003 | Frankenbach et al. | |
| 2003/0098368 | A1 | 5/2003 | Foster | |
| 2003/0100461 | A1* | 5/2003 | Catlin | B65D 65/46 510/220 |
| 2003/0100463 | A1* | 5/2003 | Delamarche | C11D 17/042 510/296 |
| 2003/0146405 | A1 | 8/2003 | Frankenbach et al. | |
| 2003/0201339 | A1 | 10/2003 | Foster et al. | |
| 2003/0215417 | A1 | 11/2003 | Uchiyama et al. | |
| 2003/0216488 | A1 | 11/2003 | Uchiyama et al. | |
| 2004/0127463 | A1 | 7/2004 | Trinh | |
| 2004/0149837 | A1 | 8/2004 | Foster | |
| 2005/0089540 | A1 | 4/2005 | Uchiyama et al. | |
| 2005/0113282 | A1 | 5/2005 | Parekh et al. | |
| 2009/0178211 | A1 | 7/2009 | Wahl et al. | |
| 2011/0186467 | A1* | 8/2011 | Denome | B65D 65/46 206/524.7 |
| 2011/0272494 | A1 | 11/2011 | Richardson et al. | |
| 2012/0181305 | A1 | 7/2012 | West et al. | |
| 2012/0183605 | A1* | 7/2012 | Arnold | A61K 9/2072 424/451 |
| 2013/0139327 | A1 | 6/2013 | Sieben et al. | |
| 2013/0273277 | A1 | 10/2013 | Lee et al. | |
| 2013/0306757 | A1 | 11/2013 | Parmentier | |
| 2013/0306767 | A1 | 11/2013 | Becker et al. | |
| 2015/0158645 | A1 | 6/2015 | Meier et al. | |
| 2015/0158646 | A1 | 6/2015 | Meier et al. | |
| 2015/0252305 | A1* | 9/2015 | Souter | C11D 3/32 510/406 |

(Continued)

FOREIGN PATENT DOCUMENTS

| | | |
|---|---|---|
| EP | WO0001421 | 1/2000 |
| EP | 0988365 | 5/2005 |

(Continued)

OTHER PUBLICATIONS

International Search Report and Written Opinion from International Application No. PCT/EP2016/068639 dated Oct. 5, 2016.

(Continued)

*Primary Examiner* — Lorna M Douyon
(74) *Attorney, Agent, or Firm* — Greenberg Traurig, LLP

(57) ABSTRACT

The present invention provides a water-soluble package comprising a water-soluble substrate and a powder coating on an exterior surface of the water-soluble substrate, wherein the water-soluble substrate encloses a composition and the powder coating includes a powdered bittering agent, a method of making such water-soluble packages and their use, in particular for washing dishes or laundering textiles.

6 Claims, No Drawings

(56) References Cited

U.S. PATENT DOCUMENTS

| | | | | |
|---|---|---|---|---|
| 2015/0252306 | A1* | 9/2015 | Souter | C11D 3/32 510/406 |
| 2015/0292141 | A1 | 10/2015 | Behr | |
| 2017/0001208 | A1 | 1/2017 | Barenhoff et al. | |
| 2017/0066999 | A1* | 3/2017 | Brandt-Sanz | C11D 1/83 |
| 2017/0067000 | A1* | 3/2017 | Brandt-Sanz | B65D 65/46 |

FOREIGN PATENT DOCUMENTS

| | | | |
|---|---|---|---|
| EP | 988364 | | 8/2005 |
| EP | 2216394 | | 11/2010 |
| EP | 2196531 | | 9/2014 |
| EP | 2933101 | | 10/2015 |
| ES | 2016450 | | 11/1990 |
| JP | 2000063204 | | 2/2000 |
| NZ | 228775 | | 10/1990 |
| WO | WO9608555 | | 3/1996 |
| WO | WO9856888 | | 12/1998 |
| WO | WO9856890 | | 12/1998 |
| WO | WO9955953 | | 4/1999 |
| WO | WO9955814 | | 11/1999 |
| WO | WO9955815 | | 11/1999 |
| WO | WO9955952 | | 11/1999 |
| WO | WO0024856 | | 5/2000 |
| WO | WO0107561 | | 2/2001 |
| WO | WO0116266 | | 8/2001 |
| WO | WO2001061100 | | 8/2001 |
| WO | WO0215663 | | 2/2002 |
| WO | 2002/026896 | A2 | 4/2002 |
| WO | WO0240623 | | 5/2002 |
| WO | WO03045813 | | 6/2003 |
| WO | WO03089561 | | 10/2003 |
| WO | WO2005025626 | | 3/2005 |
| WO | WO2008073299 | | 6/2008 |
| WO | WO2009036277 | | 3/2009 |
| WO | WO2011009100 | | 1/2011 |
| WO | WO2013158364 | | 10/2013 |
| WO | WO2014016144 | | 1/2014 |
| WO | 2014/026855 | A1 | 2/2014 |
| WO | WO2014026856 | | 2/2014 |
| WO | WO2015117625 | | 8/2015 |
| WO | 2015/134829 | A1 | 9/2015 |
| WO | WO2017025426 | | 2/2017 |
| WO | WO2018024511 | | 2/2018 |
| WO | WO2018024798 | | 2/2018 |

OTHER PUBLICATIONS

Search Report and Written Opinion in PCTEP2018076839; dated Nov. 15, 2018.
Search Report and Written Opinion in 18175375; dated Jul. 24, 2018.
Search Report and Written Opinion in PCTEP2018076838; dated Dec. 10, 2018.
Search Report and Written Opinion in PCTEP2018076841; dated Dec. 10, 2018.
Search Report and Written Opinion in PCTEP2018082740.; dated Jan. 29, 2019.
Search Report and Written Opinion in PCTEP2018082741.; dated Jan. 30, 2019.
Search Report and Written Opinion in PCTEP2018076836; dated Dec. 7, 2018.
Search Report and Written Opinion in PCTEP2018076840; dated Dec. 10, 2018.
Search Report and Written Opinion in EP16183128; dated Feb. 13, 2017.
TS800 Trigger Sprayers; TS800 Trigger Sprayers Mead Westvaco Corporation; Nov. 2013; Retrieved from the Internet: https://www.westrock.com/en/-/media/pdf/dispensers/one-pager/ts800onepagerl 1 2013.pdf Retrieved on Feb. 16, 2017.
Search Report and Written Opinion in EP16193715; dated Mar. 17, 2017.
Ghasem et al.; Background on Sprays and Their Production ; Industrial Sprays and Atomization Design Analysis and Applications; 2002; pp. 7-33; XP009195118; Chapter 2; Springer.
Search Report and Written Opinion in PCTEP2017068512; dated Oct. 5, 2017.
Search Report and Written Opinion in PCTEP2017069580; dated Nov. 16, 2017.
Search Report and Written Opinion in EP17196289; dated Mar. 27, 2018.
Search Report and Written Opinion in EP17196293; dated Mar. 22, 2018.
Search Report and Written Opinion in EP17196284; dated Mar. 27, 2018.
Search Report and Written Opinion in EP17196275; dated Apr. 19, 2018.
Search Report and Written Opinion in EP17204518; dated Jun. 11, 2018.
Search Report and Written Opinion in EP17204524; dated Jun. 13, 2018.
IPRP in PCT/EP2018/076836; IPRP in PCT/EP2018/076836; Jan. 7, 2010.
Written Opinion 2 in PCTEP2018076836; dated Aug. 23, 2019.
Search Report and Written Opinion in PCTEP2018076838; dated Dec. 8, 2018.
IPRP2 in PCTEP2018082740; Feb. 12, 2020.
UNILEVER PLC; Water-Soluble Package, Application No. EP15180624.7, filed Aug. 11, 2015; Water-Soluble Package, Application No. EP15180624.7, filed Aug. 11, 2015; Aug. 11, 2015; 18 pages.
X; Regulation No. 348/2004 of the European Parliament and of the Council; 2004RO648-EN-01.06.2015-007.001; Mar. 31, 2004; pp. 1-54.
X; Regulation No. 1272/2008 of the European Parliament and of the Council; L 353; Dec. 16, 2008; pp. 1-14.
X; Regulation No. 1297/2014 of the European Parliament and of the Council; L 350; Dec. 5, 2014; pp. 1-4; x.
X; Technical Report 191220 LAS02720EP-IX01; x; x; x; x.
IPRP in PCTEP2018076841; Jan. 24, 2020.

* cited by examiner

WATER-SOLUBLE PACKAGE

RELATED APPLICATIONS

This application is a national phase filing under 35 USC 371 of International Application No. PCT/EP2016/068639, filed on Aug. 4, 2016, which claims priority of European Patent Application No. 15180621.3, filed Aug. 11, 2015, the entirety of which are incorporated herein by reference for all purposes.

The present invention relates to a water-soluble package including a powder coating on an exterior surface of the water-soluble package, wherein the powder coating includes a bittering agent, in particular, packages containing dishwashing or laundry detergent compositions, methods of producing such packages and their use in dishwashing or textile laundering.

Water-soluble packages known in the art typically include a composition, such as a dishwashing or laundry detergent composition enclosed in a water-soluble film, container or capsule. The detergent composition can therefore be released from the water-soluble package on exposure to water during use. Such water-soluble packages provide the advantages of providing single dosing packages, the user does not need to open the package and the user is not exposed to the detergent composition before use.

Typically, the contents of such water-soluble packages must be released quickly and completely during use in water, and without leaving a residue. As a result, the water-soluble package is often a thin water-soluble film package or a thin walled water-soluble capsule or container, and may have a high water solubility or reactivity.

However, such water-soluble package may be relatively fragile. In addition, the water-soluble package may be susceptible to damage from environmental moisture. The structural integrity of the water-soluble package may be weakened and/or the water-soluble packages may have a tendency to stick together when a number of the packages are stored in close proximity over a period of time.

WO 02/26896 and JP/0129438 describe water-soluble package materials which are coated with a fine powder. Suitable powders include calcium carbonate, magnesium carbonate, clay, talc, silicic acid and kaolin. Such coating is said to provide excellent slip and anti-blocking properties.

More recently, WO 2013/158364 describes a water-soluble packet comprising a water-soluble film coated by a powder wherein the powder comprises a mixture of powdered lubricant and an active agent. The combination of a powdered lubricant and an active agent is reported to be particularly advantageous in providing the packet with additional functionality while improving the feel of the packet surface, mitigating potential weeping of liquid products onto the surface of the packet, and preventing the packets from sticking together, thereby preventing possible failure during separation. The powdered lubricant is said to be typically a starch, modified starch, silica, siloxane, calcium carbonate, magnesium carbonate, clay, talc, silicic acid, kaolin, gypsum, zeolite, cyclodextrin, calcium stearate, zinc stearate, alumina, magnesium stearate or zinc oxide. The active agent is typically one or more of enzymes, oils, flavours, colorants, odour absorbers, fragrances, pesticides, fertilisers, activators, acid catalysts, metal catalysts, iron scavengers, bleaches, bleach components or fabric softeners.

Furthermore, it is often desirable to deter humans or animals from orally ingesting the contents of water-soluble packages. Accordingly, it is known to include a bittering agent in a water-soluble package in order to produce a bitter taste in the mouth if, for example, a child attempts to eat the film package. EP 0 700 989 A1 describes a unit packaged detergent for dishwashing which may include an additive which provides an unbearable bitter taste, such as denatonium (e.g. Bitrex™). The additive may be coated onto the unit package detergent in order to improve the prevention that children may accidently ingest the package detergent.

WO 2008/034594 A1 and EP 2 196 531 A1 describe coated detergent compositions, including a water-soluble coating. Both documents note that the unit coated detergent can include a coating of an unbearable bitter tasting additive, either as part of the water-soluble coating or as a separate layer.

More recently, WO 2014/026856 A1 identifies that when the bittering agent is included in a water-soluble film at higher doses, the bittering agent can be transferred to a user's hands when handling the water-soluble film, thus leaving bitterness on the user's hands for several hours. Accordingly, WO 2014/026856 A1 describes a water-soluble package containing an agent and a water-soluble covering wherein the water-soluble covering contains a bittering agent in a diluted state in order to solve this problem.

SUMMARY OF THE INVENTION

The present inventors have investigated ways of improving water-soluble packages. The present inventors have surprisingly found that a water-soluble package including a powder coating with a powdered bittering agent powder can provide certain advantages. At its most general, the present invention provides a water-soluble package comprising a water-soluble substrate and a powder coating on an exterior surface of the water-soluble substrate, wherein the water-soluble substrate encloses a composition and the powder coating includes a powdered bittering agent.

The present inventors have surprisingly found that the bittering agent can provide both the bitter-taste deterrent effect while also providing protection against water-soluble package sticking together when in close proximity.

Accordingly, in a first aspect, the present invention provides a water-soluble package comprising a powder coating and a water-soluble substrate enclosing a composition, wherein the powder coating includes a powdered bittering agent and less than 10 wt. % of a powdered lubricating agent based on the total weight of the coating powder. The present inventors have surprisingly found that the powdered bittering agent in the coating powder can provide both taste deterrent effect and act as a powdered lubricant. As a result, additional lubricating agents are not required. The water-soluble package manufacture can thus be simplified. In addition, material costs can be reduced.

In a second aspect, the present invention provides a method of producing a water-soluble package, the method including the step of coating a water-soluble substrate enclosing a composition with a powder coating composition including a powdered bittering agent and less than 10 wt. % of a lubricating agent based on the total weight of the solids and/or non-volatiles in the powder coating composition.

In a third aspect, the present invention provides use of a water-soluble package comprising a water-soluble substrate enclosing a detergent composition and a powder coating on an exterior surface of the water-soluble substrate, wherein the coating powder includes a powdered bittering agent and less than 10 wt. % of a powdered lubricating agent based on the total weight of the powder coating.

Water-Soluble Package

"Water-soluble package" means any package construction that is suitable for enclosing and containing a composition or material, such as a dishwashing or laundry detergent composition. The water-soluble package can be in any packaging form, such as film packaging, capsules, and containers. In particular embodiments, the water-soluble package is a single dose water-soluble package.

The water-soluble package typically contains at least one compartment for containing the composition. In some embodiments, the water-soluble package includes two or more compartments. Each compartment can contain a different composition from another compartment. Alternatively, each compartment may contain a different component (or mixture of components) of a composition from another compartment. For example, the water-soluble package may contain two compartments wherein each compartment is a different mixture of components of a laundry or dishwashing composition.

Water-Soluble Substrate

The water-soluble substrate typically forms a wall or walls of the water-soluble package for enclosing a composition. The exterior surface of the substrate is a surface that is intended to be exposed to the environment during use. The exterior surface typically opposes an interior surface intended to face or abut the composition to be contained, encased or enclosed in the water-soluble package (such as a dishwashing or laundry detergent composition).

Suitable water-soluble substrate materials are known. In particular, the water-soluble substrate may include one or more water-soluble polymers. In one embodiment, the water-soluble substrate includes polyvinyl alcohol, a modified polyvinyl alcohol, polyvinyl acetate, polyacrylates, water-soluble acrylate copolymers, polyaminopropyl sulfonic acid and salts thereof, polyitaconic acid and salts thereof, polyacrylamides, polyvinylpyrrolidone, pullalan, cellulosics (such as carboxymethylcellulose and hydroxypropyl methyl cellulose), water-soluble naturla polymers (such as guar gum, xanthan gum, carrageenan and starch), water-soluble polymer derivatives (such as modified starches, including ethoxylated starch and hydroxylated propylstarch, poly(sodium acryloamido-2-methylpropane sulfonate, polymonomethylmaleate and salts thereof), copolymers thereof and combinations thereof. In some embodiments, the water-soluble substrate includes, or consists essentially of, polyvinyl alcohol, a modified polyvinyl alcohol, polyvinyl acetate, carboxymethylcellulose or hydroxypropyl methyl cellulose.

In particular embodiments, the water-soluble substrate includes, or consists essentially of, polyvinyl alcohol, polyvinyl acetate and/or a modified polyvinyl alcohol. Polyvinyl alcohol, polyvinyl acetate and modified polyvinyl alcohols can provide stable water-soluble substrates that have suitable dissolution rates.

The water-soluble substrate material may also contain one or more plasticizers. Examples of plasticizers include, but are not limited to glycerol, glycerin, diglycerin, ethylene glycol, diethylene glycol, triethylene glycol, tetraethylene glycol, monopropylene glycol, polyethylene glycol, neopentyl glycol, trimethylpropane polyether polyols, sorbitol, ethanolamines and mixtures thereof. The plasticizer, when present, may be included in the water-soluble substrate material in an appropriate amount, as generally known.

The water-soluble package substrate encloses or contains a composition or material. In use, the water-soluble substrate may dissolve in water to release the material or composition enclosed within the substrate. Such materials and compositions particularly include, but are not limited to, detergent compositions, such as dishwashing compositions and laundry detergent compositions. The material or composition may be in solid, granular, gel or liquid form.

Bittering Agent

The water-soluble package of the present invention includes a bittering agent. Bittering agents are generally known. In some embodiments, the bittering agent is selected from benzoic benzylamine amide, denatonium benzoate, denatonium saccharide, trichloroanisole, methyl anthranilate and quinine (and salts of quinine). Further examples of bittering agents include naringin, sucrose octaacetate and agents derived from plant or vegetable matter, such as chemical compounds derived from chilli pepper plants, those derived from a plant species of the genus cynaro, alkaloids and amino acids.

In some embodiments, the bittering agent is selected from the group consisting of denatonium benzoate, denatonium saccharide, quinine or a salt of quinine. The chemical name of denatonium is phenylmethyl-[2-[(2,6-dimethylphenyl) amino]-2-oxoethyl]-diethylammonium, and denatonium benzoate is available commercially as Bitrex™. In particular embodiments, the bittering agent is denatonium benzoate or denatonium saccharide.

The water-soluble package includes the bittering agent as powdered bittering agent in the powder coating. In preferred embodiments, the powdered bittering agent is the sole bittering agent of the water-soluble package. Such an arrangement simplifies the processing of the water-soluble packages.

In alternative embodiments, the water-soluble package may additionally include a bittering agent contained within (i.e. incorporated in or blended with) or film-coated on at least part of the water-soluble substrate. The bittering agent can be substantially homogenously mixed with the water-soluble substrate material before water-soluble substrate is formed. In this way, the production of the water-soluble package with the bittering agent is simplified. The bittering agent may be incorporated into the matrix of a water-soluble polymer included in the water-soluble substrate by dissolving the bittering agent in a water-soluble polymer solution before the water-soluble substrate is formed. The bittering agent may be present in water-soluble substrate material in a range of 100 to 5000 ppm, preferably 200 to 3000 ppm, more preferably 500 to 2000 ppm, based on the weights of the bittering agent and water-soluble substrate. For example, 1 mg of bittering agent may be incorporated into 1 g of water-soluble substrate to provide the bittering agent at 1000 ppm.

Film-coating of a bittering agent on the surface of the water-soluble substrate can be performed by known techniques, such as spraying of a bittering agent solution onto the surface of the water-soluble substrate.

Powder Coating

The water-soluble package includes a powder coating on an exterior surface of the water-soluble substrate, the powder coating including a powdered bittering agent. Optionally, the powder coating can include less than 10 wt. % of a powdered lubricating agent based on the total weight of the powder coating.

The powder coating typically is applied to at least 50% by area of the exterior surface of the water-soluble substrate. In some embodiments, the powder coating is applied to 60% or more, 70% or more, 80% or more, or 90% or more by area of the exterior surface of the water-soluble substrate. The powder coating can be applied by any known technique such as spray-coating or passing the water-soluble substrate through a falling curtain of powder coating composition.

The powder coating may be applied to the exterior surface of the water-soluble substrate at a rate of 0.5 to 10 mg per 100 $cm^2$, in some embodiments not more than 5 mg per 100 $cm^2$, and in further embodiments in the range of 1.25 to 2.5 mg per 100 $cm^2$. Alternatively, the powder coating is applied to or present on the exterior surface of the water-soluble substrate in an amount of 100 ppm or more, preferably 200 ppm or more, more preferably 300 ppm or more, based on the weights of the powder coating and the water-soluble substrate. For example, a 1 mg of powder coating may be applied to a 1 g capsule to provide a 1000 ppm coating on the capsule. In certain embodiments, the powder coating is applied to or present on the exterior surface of the water-soluble substrate in a range of 100 to 5000 ppm, preferably 200 to 3000 ppm, more preferably 300 to 2000 ppm.

The powdered bittering agent typically forms 10 wt. % or more of the powder coating based on the total weight of the powder coating. In some embodiments, the powdered bittering agent forms at least 50% by weight of the powder coating based on the total weight of the powdered coating. In some embodiments, the powdered bittering agent is present as 75% by weight or more, 85% by weight or more or 95% by weight or more of the powder coating based on the total weight of the powdered coating. In some embodiments, the powdered coating consists essentially of the powdered bittering agent.

The powdered bittering agent may have an average particle diameter of at least about 0.1 microns. The powdered bittering agent may have an average particle diameter of about 200 microns or less. In some embodiments, the powdered bittering agent has an average particle diameter of in the range of about 0.1 to 100 microns, in other embodiments in the range of about 0.1 to 20 microns and in further embodiments in a range of about 5 and 15 microns. Average particle diameter can be measured by known optical imaging techniques. For example, the diameter of all particles within a fixed area under a microscope (or other optical imaging device) can be measured and the mean diameter calculated. The diameter can be taken as the major dimension for irregularly shaped particles.

The powder coating can optionally include a powdered lubricating agent, and the powdered lubricating agent is present in less than 10 wt. % or more based on the total weight of the powder coating. As will be appreciated, the powdered bittering agent can effectively act as a powdered lubricating agent. However, as is clear from the discussion herein, the limit of 10 wt. % of the powdered lubricating agent is not a limit on the powdered bittering agent.

Typical powdered lubricating agents include oligosaccharide, polysaccharide and inorganic lubricating agents. The powdered coating may include one or more of the group selected from starch, modified starches (including, but limited to, corn starch, potato starch or hydroxyethyl starch) silicas, siloxanes, calcium carbonate, magnesium carbonate, clay, talc, silicic acid, kaolin, gypsum, zeolites, cyclodextrins, calcium stearate, zinc stearate, alumina, magnesium stearate, sodium sulphate, sodium citrate, sodium tripolyphosphate, potassium sulphate, potassium citrate, potassium tripolyphosphate, and zinc oxide. In a preferred embodiment, the powdered lubricating agent includes talc.

In some embodiments, the powder coating includes less than 5 wt. %, less than 2 wt. %, less than 1 wt. % or less than 0.5 wt. % of a powdered lubricating agent. In some embodiments, the coating powder contains essentially no powdered lubricating agent. In other words, the coating powder may be essentially free from powdered lubricating agents.

In another embodiment, the coating powder includes less than 10 wt. %, less than 5 wt. %, less than 2 wt. %, less than 1 wt. % or less than 0.5 wt. % of, contains essentially no, or is essentially free from powdered inorganic, oligosaccharide or polysaccharide lubricating agents.

In another embodiment, the coating powder includes less than 10 wt. %, less than 5 wt. %, less than 2 wt. %, less than 1 wt. % or less than 0.5 wt. % of, contains essentially no, or is essentially free from starch, modified starches (including, but limited to, corn starch, potato starch or hydroxyethyl starch) silicas, siloxanes, calcium carbonate, magnesium carbonate, clay, talc, silicic acid, kaolin, gypsum, zeolites, cyclodextrins, calcium stearate, zinc stearate, alumina, magnesium stearate, sodium sulphate, sodium citrate, sodium tripolyphosphate, potassium sulphate, potassium citrate, potassium tripolyphosphate, and zinc oxide.

The powdered lubricating agent, when present, may have an average particle diameter of at least about 0.1 microns. The powdered lubricating agent may have an average particle diameter of about 200 microns or less. In some embodiments, the powdered lubricating agent has an average particle diameter in the range of about 0.1 to 100 microns, in other embodiments in the range of about 0.1 to 20 microns and in further embodiments in the range of about 5 and 15 microns. Average particle diameter can be measured by known optical imaging techniques.

In some embodiments, the powder coating further includes one or more additional active agents. The additional active agent may be selected from one or more of the group of enzymes, oils, odour absorbers, fragrances, bleaches, bleach components, cleaning polymers, soil release polymers, EPEI, water softeners, dyes and fabric softeners.

Method of Making a Water-Soluble Package

The water-soluble packages of the present invention can be manufactured using standard known techniques. For example, the water-soluble substrate is typically formed (preferably thermo-formed) into a water-soluble substrate enclosure (e.g. a film pocket, open capsule or container). The water-soluble substrate enclosure may then be filled with a composition such as a dishwashing or laundry detergent composition. The water-soluble enclosure containing the composition or material can then be sealed, for example by sealing the edges of the enclosure or joining the enclosure with one or more additional pieces of water-soluble substrate, in order to enclose the material or composition in the water-soluble package.

A powder coating composition may then be applied to the exterior surface of the water-soluble substrate. The powder coating composition may be applied to the water-soluble substrate by any known technique that creates a powder. For example, the powder coating composition may be spray-coated onto the water-soluble substrate. Alternatively, the water-soluble substrate may be passed through a falling curtain of the powder coating composition.

The powder coating composition typically includes the bittering agent and optionally less than 10 wt. % of a lubricating agent. The powder coating composition can include one or more liquid volatile solvents. The powder coating composition may be a solution or suspension containing the powder coating components. The powder coating composition typically includes less than 10 wt. % of a lubricating agent based on the total weight of solids and/or non-volatiles in the powder composition. In this way, the powder coating resulting from the powder coating composition includes less than 10 wt. % of the lubricating agent based on the total weight of the powder coating.

In preferred embodiments, the powder coating composition contains no solvent or a non-aqueous solvent. Such non-aqueous application reduces the risk of dissolving the water-soluble substrate. In particular embodiments, the powder coating composition is a powder containing a powdered bittering agent and less than 10 wt. % of a lubricating agent based on the total weight of the powder coating composition.

In a particular embodiment, the present invention provides a water-soluble package comprising a powder coating and a water-soluble substrate enclosing a composition, wherein the powder coating includes a powdered bittering agent selected from the group consisting of denatonium benzoate, denatonium saccharide, quinine or a salt of quinine, and the powder coating is substantially free from powdered lubricating agent.

The above optional and preferred features are equally combinable and applicable to all aspects of the invention, unless indicated otherwise.

DETAILED DESCRIPTION

The invention will be described in more detail with reference to specific embodiments and examples.

EXAMPLES

General Coating Procedure

A tub of 35 liquid laundry detergent capsules having a polyvinyl alcohol thin film wall were coated with a powder coating using the following protocol.

Protocol

1) Mill the Bitrex™ crystals to a fine powder (<180 microns);
2) Empty full tub of capsules into plastic bag;
3) Add specified amount of Bitrex™ powder to the bag;
4) Close the bag;
5) Shake the plastic bag with capsules and Bitrex™ powder for 1 minute;
6) Place the plastic bag with capsules into the original tub.

A tub of 35 liquid laundry detergent capsules having a polyvinyl alcohol thin film wall without any powder coating were tested as a control. Bitrex™ was added to the bag in the following amounts:

| Example | Bitrex ™ (mg) |
|---|---|
| Control | — (none added) |
| 1 | 29.1 |
| 2 | 73.1 |

Examples 1, 2 and the Control were submitted to a taste aversion test. Examples 1 and 2 passed the test (namely producing a suitable taste aversion response from the taste testers), whereas the Control failed the test.

In addition, the Example capsules are relatively stable under simulated age test conditions. In contrast, the Control samples will tend to stick together under simulated age test conditions.

The invention claimed is:

1. A water-soluble package consisting of a water-soluble substrate enclosing a composition forming at least one compartment, and a powder coating on an exterior surface of the water-soluble substrate, wherein the powder coating consists of a powdered bittering agent, and wherein the powdered bittering agent has an average particle size of 0.1 to 200 microns.

2. The water-soluble package according to claim 1, wherein the powdered bittering agent is selected from the group consisting of denatonium benzoate, denatonium saccharide, quinine, or a salt of quinine.

3. The water-soluble package according to claim 1, wherein the water-soluble substrate is selected from the group consisting of polyvinyl alcohol, modified polyvinyl alcohol, polyvinyl acetate, carboxymethylcellulose or hydroxypropyl methyl cellulose.

4. The water-soluble package according to claim 1, wherein the package has two or more compartments.

5. The water-soluble package according to claim 1, wherein the composition is a dishwashing or laundry detergent composition.

6. A method of producing a water-soluble package, the method comprising the step of:

coating a water-soluble substrate enclosing a composition with a powder coating composition, wherein the powder coating composition consists of a bittering agent, and wherein the powdered bittering agent has an average particle size of 0.1 to 200 microns.

* * * * *